US007899678B2

(12) United States Patent
Theil

(10) Patent No.: US 7,899,678 B2
(45) Date of Patent: Mar. 1, 2011

(54) FAST TIME-SCALE MODIFICATION OF DIGITAL SIGNALS USING A DIRECTED SEARCH TECHNIQUE

(76) Inventor: Edward Theil, Oakland, CA (US)

( * ) Notice: Subject to any disclaimer, the term of this patent is extended or adjusted under 35 U.S.C. 154(b) by 1085 days.

(21) Appl. No.: 11/622,440

(22) Filed: Jan. 11, 2007

(65) Prior Publication Data

US 2008/0170650 A1 Jul. 17, 2008

(51) Int. Cl.
*G10L 21/04* (2006.01)

(52) U.S. Cl. ..... 704/503; 704/504

(58) Field of Classification Search ..... 704/503–504
See application file for complete search history.

(56) References Cited

U.S. PATENT DOCUMENTS

| | | | | |
|---|---|---|---|---|
| 4,864,620 | A | 9/1989 | Bialick | |
| 5,749,064 | A * | 5/1998 | Pawate et al. | 704/213 |
| 6,173,255 | B1 * | 1/2001 | Wilson et al. | 704/216 |
| 7,526,351 | B2 * | 4/2009 | He et al. | 700/94 |
| 2005/0038534 | A1 * | 2/2005 | Sakurai et al. | 700/94 |
| 2005/0273321 | A1 | 12/2005 | Choi | |
| 2006/0277052 | A1 * | 12/2006 | He et al. | 704/503 |
| 2007/0055397 | A1 * | 3/2007 | Steinberg | 700/94 |

OTHER PUBLICATIONS

Portnoff, Michael, "Time-Scale Modification of Speech Based on Short-Time Fourier Analysis", IEEE Transactions on Acoustics, Speech, and Signal Processing, Jun. 1981, pp. 374-390, vol. ASSP-29, No. 3.

Roucos, et al., "High Quality Time-Scale Modification for Speech", IEEE, 1985, pp. 493-496.

Wong, J. et al., Fast Time Scale Modification Using Envelope-Matching Technique (EM-TSM), ISCAS '98 Proceedings of the IE Symposium on Circuits and Systems, May 31-Jun. 3, 1998.

* cited by examiner

*Primary Examiner*—Richemond Dorvil
*Assistant Examiner*—Douglas C Godbold
(74) *Attorney, Agent, or Firm*—Brill Law Office; Jeffrey Brill

(57) ABSTRACT

The time-scale of a digital signal is efficiently modified. A system suitable for embedded or stand-alone processing includes a module that can transform the time-scale of the signal according to a user's preference. An improved method for time-scale modification is based on envelope-matching but introduces a new function that is very fast to compute, the use of which avoids the computation of correlation coefficients where they are not needed. The invention is demonstrably faster than other methods related to SOLA (synchronized-overlap-and-add) with envelope matching, yet with no sacrifice in quality of the processed output.

27 Claims, 5 Drawing Sheets

Target Segment Shifted vs. Source Segment

Optimal Alignment and Cross-Fading

Example of Directed Search, I solid line: r(k), if computed for every k
+: those k for which r(k) was actually computed

Example of Directed Search, II solid line: r(k), if computed for every k
+: those k for which r(k) was actually computed

FAST TIME-SCALE MODIFICATION OF DIGITAL SIGNALS USING A DIRECTED SEARCH TECHNIQUE

TECHNICAL FIELD

This invention pertains generally to the field of digital signal processing, and more specifically to the technique of time-scale modification of digital signals.

BACKGROUND ART

Time-scale modification (TSM) refers to the ability to compress or expand a digital signal in time, while largely preserving the pitch, other dominant frequencies and phase of the signal. Thus, the frequencies present at time t in a digital signal would be the same frequencies present at time at in the processed signal, where $\alpha$ can be <1 (signal is speeded-up, or compressed in time) or $\alpha$>1 (signal is slowed down, or expanded in time). If the signal is audio, the technique avoids the increase or decrease in pitch (e.g., the "chipmunk" sound in the former case) that results when the signal is merely played back at a different speed.

TSM is well known in the Art and a number of patents and patent applications in this area are listed on the USPTO website. This section discusses the patents and journal articles in the Prior Art believed to be most relevant to the present invention.

There are a number of useful applications of TSM. The following list is intended to be merely illustrative rather than exhaustive. TSM is used most obviously when one wishes to increase the playback speed of recorded digital audio speech. Blind people or people who otherwise suffer reading or sight disabilities often make use of this capability in digital players. General listeners who record lectures will do the same thing. TSM is also used in digital audio compression [Wilson et al., U.S. Pat. No. 6,173,255 B1], a technique wherein the file is first compressed ($\alpha$<1) and, at a later time, expanded by $1/\alpha$. Another application is the suppression of uncorrelated noise, also discussed in [Wilson et al.], and a fourth application involves the synchronization of the audio signal of a video broadcast with the video signal when it is in fast-forward mode. Recently, TSM has also been used in various digital watermarking schemes.

As with much else in digital signal processing, there are two main avenues of approach to TSM: the frequency domain and the time domain. Call the original signal the source and the resulting processed signal the target. In most cases, the signal is conceptually partitioned into short frames to avoid the statistical non-stationarity inherent in most audio and video signals. In a frequency domain approach, the short-term discrete Fourier transform (or its equivalent) is used [Portnoff, 1981] to determine the frequencies in the source frame and in the target frame and an iterative approach may be employed to minimize (in the least squares sense) the distance between the two transforms. Given sufficient time, this approach can provide good results in terms of audio fidelity, but it is computationally very intensive. For example, one minute of music sampled at 44.1 KHz stereo produces approximately 5.3 million digital samples, typically of two bytes each. A typical frame length of 20 milliseconds would contain 882 samples. The analysis of each frame could involve iterating an indeterminate number of Fourier transforms of length up to 1024 (the first power of 2 greater than the frame size) and then repeating that fifty times each second.

[Roucos, et al., 1985] proposed a time-domain method for overlapping and aligning short frames of the target file against the corresponding source frames and then "cross-fading" the two frames together using a weighted average or other digital filter technique to create a final output frame. The acronym given to this technique is SOLA. The key idea in SOLA is the calculation of normalized cross-correlation coefficients r(k) between the digital values of the source frame and those of the target frame in order to determine the best point at which to align the two frames.

From [Roucos, 1985], the general correlation coefficients for the first frame and for frame m+1 are given by:

$$r(k) = \frac{\sum_{i=1}^{L-k} y(k+i)x(i)}{\left[\sum_{i=1}^{L-k} y^2(k+i) \sum_{i=1}^{L-k} x^2(i)\right]^{1/2}} \tag{1}$$

$$r(k) = \frac{\sum_{i=1}^{L-k} y(mSy+k+i)x(mSx+i)}{\left[\sum_{i=1}^{L-k} y^2(mSy+k+i) \sum_{i=1}^{L-k} x^2(mSx+i)\right]^{1/2}} \tag{2}$$

$$k = 1, 2, \ldots, k\max$$

Here, the parameter k is the "lag" or offset or shift-value used in aligning one segment against the other. When r(k) is maximum, it is an indication that the two segments are optimally correlated, and the corresponding value of k serves as the alignment point between the two frames, as indicated in FIG. 2. The target frame is synthesized from the source frame such that it is approximately $\alpha$ times the length of the latter, thereby ensuring the proper time duration per frame. The equations for the normalized correlation coefficients used in this technique are shown above and the cross-fading process is shown in the drawing of FIG. 3. Equations (1) and (2) also implicitly indicate that the calculation of r(k) is usually implemented by a computational loop involving multiplications and additions of values in the overlap. Moreover, a second outer loop steps through the values of k from 1 to a predetermined maximum.

Because a high correlation indicates that the dominant frequencies present in the two frames are also well-correlated, this time-domain approach is both intuitive and technically persuasive. Subjective and objective studies have demonstrated that it produces good quality audio even at relatively high compression and expansion factors. However, it too is computationally intensive because, at high sampling rates, it requires the calculation of cross-correlation coefficients of many frames per second, with each frame containing hundreds of possible alignment points (shift-values) and, for each such point, the calculation of r(k) will involve hundreds of additions and multiplications and divisions. Sampling at the standard CD rate of 44.1 kHz requires that just the calculation of the values of r(k) alone will require tens of millions of arithmetic operations per second. This is a direct consequence of the definitions of equations (1) and (2).

Significant improvements both in time and simplicity are described in [Wong et al.] and [Wilson et al., U.S. Pat. No. 6,173,255 B1]. In the approach given there, only the envelopes of the digital waveforms are used to calculate the modified cross-correlation coefficients. Since the computations involve only the signs of the signal values, the resulting formula for the modified r(k) is simplified, particularly with respect to the normalization factors (which reduce to a single division) and the option of replacing multiplications in the equations (1) and (2) by an XOR operation. The modified expressions for frame m+1 are shown as Equation (3) below. This technique is called "envelope matching" (EM) in [Wong et al.] or "1-bit correlation" [Wilson et al., U.S. Pat. No. 6,173,255 B1].

$$r(k) = \frac{\sum_{i=1}^{L-k} \text{sign}(y(mSy+k+i))\text{sign}(x(mSx+i))}{L-k} = \frac{\sum XOR(\text{sign}(y(mSy+k+i)),\ \sim\text{sign}(x(mSx+i)))}{L-k} \quad (3)$$

$$k = 1, 2, \ldots, k\max$$

In [Wong et al.] it was also pointed out that the zero-crossings of both the source and target signals were critical for achieving even greater computational savings.

In addition, [Wong et al.] provide formulas for the recursive calculation of r(k) and related results. These ideas, however, depend on first finding the zero-crossings of both the source and target files, merging and sorting them and determining the set of zero-crossing points that are not common to both. Then this set must be updated for each k. This task itself can be computationally complex. If, for example, the signal consists of two stereo channels that have been digitized at 44.1 kHz, and if even ⅕ of the Nyquist frequency is present (i.e., approximately 4400 Hz), the number of zero crossings per second per channel may number in the thousands. Since the target signal attempts to reproduce the same frequencies, it will have approximately the same number of zero-crossings per unit of time. Thus, to produce, say, one-half second of processed audio from one second of the source file would involve (by rough approximation) sorting sets with a total of 8800.times.4400 elements per second of source audio, prior to calculation of the correlation coefficients themselves. This places a significant burden on the processor, especially when operating in real-time in an inexpensive digital player.

In [Wilson et al., U.S. Pat. No. 6,173,255 B1] an innovation is taught wherein the signs of the signal values are packed as individual bits into machine words and the computation of r(k) is performed using the XOR operation on pairs of such words, one element of the pair from the source signal, the other from the target. This method avoids ordinary multiplication and has the advantage of replacing with a single operation the serial application of as many as 16 or 32 or 64 logical operations performed serially, depending on machine word size. However, the method still requires that the number of ones or zeros generated by each XOR operation be counted, and that the bits be packed appropriately. The method also teaches that all the r(k) be calculated in this manner for every k in order to determine the maximum, and the normalization factor must be part of the calculation for a correct comparison.

In [Bialick, U.S. Pat. No. 4,864,620], a method is described which uses the Average Magnitude Difference Function to calculate correlation coefficients for the SOLA method. The chief advantage of this method is that multiplications are not required. However, normalization in order to directly compare r(k) for different k is still needed, and so is the full calculation of r(k) for each k.

In [Patent Application 2005/0038534 A1 (Sakurai)], a method similar to that of [Wong et al.] is taught, with the additional feature that the interval over which the correlation coefficients are computed is independent of k and therefore no normalization is required. The claims involve in part an avoidance of normalization and an additional speed-up factor of approximately two because the interval of calculation of r(k) is only half the nominal length. (A practitioner in the field might observe that the reduction in computation due to this smaller "cross-correlation buffer" is in fact not as great as claimed, because the more usual approach uses a decreasing overlap as k increases, so the average overlap length, which is the determining factor here, is comparable in the two cases). Here, too, r(k) is calculated for all the k in the range specified. This can vary from, say, 80 k's for 8 Khz sampling to as many as 800 or more for DVD quality sampling. The precise number depends on the implementation and audio considerations.

In [Patent Application 2005/0038534 A1, W. Y. Choi], a method based on [Roucos, 1985] is described. The innovations taught are essentially two: the method skips some of the k's when computing the r(k), and for each r(k), the method uses a reduced subset of the sample values. No data are presented to justify the two modifications in terms of audio quality, although it is stated that the errors introduced are ignorable. Moreover, for those r(k) that are computed, full calculation and normalization is taught in the form of equation (2).

While these innovations have increased computational efficiency, the need for even faster methods has been driven by the rising standards for recordings on various media. For example, the standard for music CDs is 44.1 kHz per stereo channel and the standard for DVD recordings is 96 kHz per channel. Even monophonic speech is now routinely recorded at these rates, rather than at the much lower rates of twenty years ago. The equations (1), (2) and (3) above show that both of the two computational loops involved for each frame grow in rough proportion to the sampling rate, resulting in overall growth in computation as the square of the sampling rate. Thus, while innovation has been lively in the area of TSM for the past twenty-five years, the need for even more efficient methods remains. This is particularly true with the introduction of handheld digital audio and video players that run on small capacity batteries and therefore incorporate low-power processors without floating-point arithmetic units in hardware. Consequently, their performance does not approach that of desktop or laptop computers, yet their tasks typically have real-time performance requirements. What are needed are methods, computer readable media and computer systems for a faster and practical approach to time-scale modification of digital signals.

REFERENCES

Journal and Conference Papers

1. S. Roucos, A. M. Wilgus, "High Quality Time Scale Modification for Speech", Proc. IEEE. Conf On Acoustics, Speech and Signal Processing, Vol. I, pp 493-496, 1985.
2. J. W. C. Wong, O. C. Au, P. H. W. Wong, "Fast Time Scale Modification Using Envelope-Matching Technique (EM-TSM)". Proc. Of 1998 IEEE Sym. On Circuits and Systems, Monterey, Calif., June, 1998
3. M. R. Portnoff, "Time Scale Modification of Speech Based on Short Time Fourier Analysis", IEEE Trans. On Acoustics, Speech, Signal Processing, Vol. 9, pp 374-390, June 1981

U.S. Patents and Patent Applications

1. U.S. Pat. No. 4,864,620, Bialick, "Method For Performing Time-Scale Modification of Speech Information or Speech Signals", Sep. 5, 1989
2. U.S. Pat. No. 6,173,255 B1, Wilson et al., "Synchronized Overlap Add Voice Processing Using Windows and One-Bit Correlators", Jan. 9, 2001
3. Patent Application US 2005/0038534 A1, Sakurai et al., "Fixed-Size Cross-Correlation Computation Method for Audio Time-Scale Modification", Feb. 17, 2005
4. Patent Application US 2005/0273321 A1, Choi "Audio Signal Time-Scale Modification Method Using variable Length Synthesis And Reduced Cross-Correlation Computations", Dec. 8, 2005

SUMMARY OF THE INVENTION

Methods, computer readable media and systems provide fast, computationally efficient time-scale modification. As with the methods of Wilson and Wong described above, the transformation uses envelope matching (EM) and depends on determining the optimum points at which the transformed signal is aligned in the time domain with the source signal. While such transformations have been taught in the past, the present invention addresses all of the problems discussed above. It starts with a new and less complex recursion formula than previously given. Rather than use that formula directly however, a simpler function is derived from it that determines whether a correlation coefficient at shift-value k+1 will be larger or smaller than the one at shift-value k, without having to calculate the actual coefficients themselves. Given that information, a method according to the present invention can quickly search for local maxima and skip over intervals where r(k) is just increasing or decreasing.

As a consequence, the invention taught here is less computationally intensive and faster than other methods related to EM in terms of the number of arithmetic operations required for each offset value k. Except at local maxima which are located by the technique to be described below, it does not use scaling or floating point nor does it use either multiplications or divisions or even the explicit calculation of r(k) itself. Even so, it can provide results that are identical to those of EM or one-bit correlation. In addition, it uses only the zero-crossing set of the target signal and therefore avoids the need to sort sets of any kind. Frames with fewer zero-crossings are processed faster than those with more zero-crossings but, in every frame, the number of arithmetic operations required to determine the optimum k is less than the number required by the prior methods. It also is near optimal in the number of operations required for each potential shift-value k in the frame, in a precise sense to be explained in detail below. Finally, it is computationally efficient in that it uses a directed search technique, also taught in detail below, which avoids computation where it is not needed.

As discussed earlier, the computational power of personal computers is not generally available in small, low-cost, consumer-oriented devices such as digital recorders and players, even as the audio standards have become more demanding. Thus, a simple, faster algorithm for TSM is highly desirable. Even when the real-time constraints are not so severe, the time saved in the TSM process with this invention can permit the use of additional signal processing techniques to improve audio quality and perform related tasks.

The features and advantages described in this summary and in the following detailed description are not all-inclusive, and particularly, many additional features and advantages will be apparent to one of ordinary skill in the relevant art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

For clarity, the disclosure of this invention is in three sections. The first section describes a system for an embodiment of the invention. The second provides a detailed derivation of new formulas for r(k) and sl(k), that allow the use of the technique we call Directed Search. The third section discloses the details of the TSM method using Directed Search and includes a glossary of relevant parameters and functions.

I. DETAILED DESCRIPTION OF AN EMBODIMENT OF THE INVENTION

Figure 1:
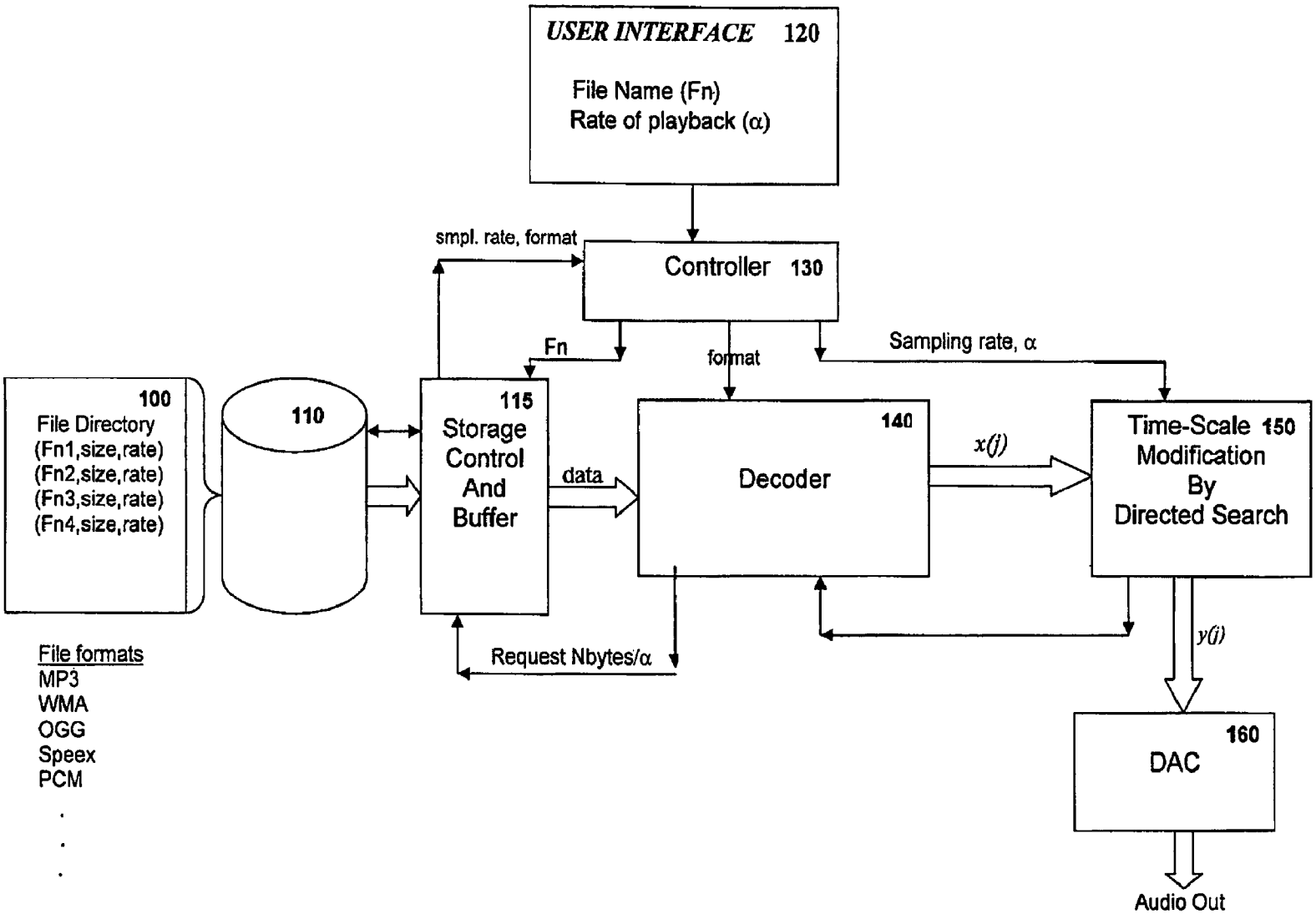
FIG. 1 is a block diagram illustrating a system for time-scale modification of digital signals according to some embodiments of the present invention.

FIG. 1 illustrates a system in which the TSM module is embedded in a simple real-time architecture. It is to be understood that the real-time aspects of FIG. 1 are exemplary only and that the TSM module may also be part of other embodiments. It is to be further understood that although various components are illustrated in FIG. 1 and in FIG. 4 as separate entities, each illustrated component represents a collection of functionalities, which can be implemented as software, hardware, firmware or any combination of these. Where a component is implemented as software, it can be implemented as a standalone program, but can also be implemented in other ways, for example as part of a larger program, as a plurality of separate programs, as a kernel loadable module, as one or more device drivers or as one or more statically or dynamically linked libraries.

A variety of digital files may reside on storage media 110 and may be catalogued in a File Directory (Block 100). These files may include but are not limited to the formats listed, all of which pertain to one or more standard digital formats. Each file will typically contain, in addition to compressed or non-compressed content, pertinent "meta-information", including the format and rate at which the original analog signal was sampled. In this embodiment, that information resides in a File Directory, but other choices will be readily apparent to one of ordinary skill in the relevant art in light of this specification, such as embedding the meta-information in file headers.

In this embodiment, a user requests that a specific file be played, by choosing from a visual or audible menu presented at the user interface (block 120). The user can also specify a "speed-up" or "slow-down" factor, denoted here by $\alpha$, which determines the rate at which the file is played back. If no $\alpha$ is specified, it is taken to be equal to 1, so that the playback is at normal speed.

The controller 130 sends the file name to the Storage Control and Buffer module 115. This module reads the file size, format and sampling rate from the File Directory and sends that information back to the controller 130. Block 115 then starts to read as much of the requested file as its buffer capacity can accept. The Controller uses the file format to select the appropriate decoder and sends the sampling rate and $\alpha$ to the TSM module at block 150.

The TSM module will use those two values for two purposes: to set the parameters for the TSM method described below and to formulate the request for data from the decoder module 140. For simplicity, FIG. 1 shows one decoder module, although in practice each audio format may have its own decoder.

The required data rate to the TSM module is PlayingTime/$\alpha$. For example, if $\alpha$=0.5, so that the file is to be played back at twice normal speed, two seconds of samples of the original file are required to produce one second for playback. Given the sampling rate (in number of samples per second) and $\alpha$, module 150 can formulate the request to the decoder, either in samples or in bytes.

The decoder 140 takes the request from the TSM module and, in turn, requests a transfer of data from the Buffer 115, which it then proceeds to decode according to the file format (e.g., MP3, Speex, etc.) The decoded signal fragment is transferred to the TSM module where it is processed as described in detail in the third section below. As the TSM module finishes frames, it continually issues requests for data until the file is exhausted.

In some embodiments, after the initial short interval during which the first data request is made and the first fragment processed, the system must operate under the real-time constraints of the task. E.g., if the TSM module produces one-half second of transformed signal from one second of the original signal, the transfer, decoding and processing of one second of the original signal must occur in less time than the playing of the one-half second of transformed data.

In this embodiment, once the TSM module has processed the fragment, it is passed to a digital-to-analog converter and then made available to the user. A person of ordinary skill in the relevant art will understand that, depending on the particular application, the transformed data may be used in other ways and applications.

II. THE FUNCTION sl(k)

Using just the envelope-matching definition of r(k) Eq. (3) above), one may write $$r(k+1)-r(k)=\left(\frac{\dfrac{\sum_{i=1}^{L_{k+1}}\operatorname{sign}(y(k+1+i))\operatorname{sign}(x(i))}{L_{k+1}}}{\dfrac{\sum_{i=1}^{L_k}\operatorname{sign}(y(k+1))\operatorname{sign}(x(i))}{L_k}}\right) \tag{2-1}$$

where $L_k$ is the length of the overlap between the source frame and the target frame shifted k units to the left. In general, $L_k$=L−k where L is the overlap at the 0-th shift-value. After some algebra to combine fractions, $$r(k+1)-r(k)=\left(\begin{array}{c}\dfrac{\sum_{i=1}^{L-k}\operatorname{sign}(y(k+i))\operatorname{sign}(x(i))}{(L-k)(L-k-1)}+\\ \dfrac{\sum_{i=1}^{L-k-1}\left[\begin{array}{c}\operatorname{sign}(y(k+1+i))-\\ \operatorname{sign}(y(k+i))\end{array}\right]\operatorname{sign}(x(i))}{L-k-1}-\\ \dfrac{\operatorname{sign}(y(L))\operatorname{sign}(x(L-k))}{L-k-1}\end{array}\right)$$

While this initially appears much more complicated, the first of the three terms above is simply $$\frac{r(k)}{L-k-1}.$$

It is important to understand that the expression in square brackets in the second term must be zero except when y(k+1+i) is a zero-crossing. When that is the case, the expression evaluates to either +2 or −2, depending on whether y(k+1+I) is positive or negative. Then, because the sum is over successive zero-crossings, the differences must alternate in sign. Thus, the formula reduces to the first and third terms and the alternating sum of as many sign(x(i)) as there are zero-crossings in the current overlap interval. The factor of two can be implemented as a left shift of the sum. Finally, because the term sign(y(L)) does not involve k, it is a constant, ±1, and therefore no multiplication is required in this term either. The simplified version of equation (2-1) can therefore be written as $$r(k+1)-r(k)=\frac{1}{L-k-1}\left(r(k)+\left[\begin{array}{c}2\sum_{i}\pm\operatorname{sign}(x(i))\pm\\ \operatorname{sign}(x(L-k))\end{array}\right]\right) \tag{2-2}$$

where the sum is taken over those i determined by the zero-crossings in y shifted k units. The ambiguity in signs is resolved by the computation for each k.

For ease of notation, call the expression inside the square brackets sl(k). That is, $$sl(k) = 2\sum_i \pm \text{sign}(x(i)) \pm \text{sign}(x(L-k)), \quad (2\text{-}3)$$

where the ambiguities in all the additions are resolved by the sign of the first zero-crossing and the sign of y(L). sl(k) may be thought of as the unnormalized slope of r(k).

Two observations about the properties of sl(k) are important for what follows. First, the summation in sl(k) only involves values of x(i) determined by the zero-crossings of y. In general, there are far fewer such values in each frame than the total number of samples. Second, equation (2-3) shows that sl(k) has the form ±(2n+1) for some integer n; i.e., sl(k) can only be an odd positive or negative integer. Rewriting (2-2) with the new notation:

$$r(k+1) - r(k) = \frac{1}{L-k-1}(r(k) + sl(k)) \quad (2\text{-}4)$$

A Test For Increasing and Decreasing r(k)

In equation (2-4) k is always constrained to be less than L−1, so the l.h. side of (2-4) is >0 if and only if r(k)+sl(k)>0. Assume sl(k)>0. Then sl(k)≧1 because sl(k) can only be an odd integer (see remark above). On the other hand, −1≦r(k)≦1, by equation (2-1). Therefore r(k)+sl(k)≧r(k)+1≧0. It follows that if sl(k)>0, then r(k+1)≧r(k) and, in fact, there is strict inequality unless r(k)=−1 and sl(k)=1, an extremely rare occurrence which is not relevant here.

Entirely analogous reasoning shows that if sl(k)<0, then r(k)+sl(k)≦0 so r(k+1)≦r(k) with equality only if r(k) is already at its maximum, 1. Thus, combining these observations, $$r(k) \leqq r(k+1) \text{ if and only if } sl(k) > 0 \quad (2\text{-}5a)$$

and, for emphasis, $$r(k) \geqq r(k+1) \text{ if and only if } sl(k) < 0. \quad (2\text{-}5b)$$

That is, r(k) is non-decreasing if sl(k) is positive and r(k) is non-increasing if sl(k) is negative. This result permits the rapid identification of local maxima of r(k) in each frame without resorting to the full evaluation of equation (2-1), regardless of how that evaluation is accomplished. The test for a local maximum at k is simply: sl(previous k)>0 and sl(k)<0. Because the number of k's is large relative to the number of local maxima, r(k) will be evaluated in only a small fraction of the potential cases. The next section discloses how this test is used in an embodiment of the present invention.

III. DISCLOSURE OF THE METHOD IN THIS EMBODIMENT

Glossary

A variety of mathematical constructs and parameters inevitably appear in the detailed discussion of this invention. This short glossary is intended as a reference to the most important of them.

x(j): the j-th sample in the source signal y(j): the j-th sample in the target (transformed) signal N: the number of samples in a frame m: the index used to count frames and establish starting and stopping points within a frame.

α: the compression or expansion factor

Sx: The number of samples in a segment of the source signal

Sy: the number of samples in a segment of the target signal; it is equal to αSx

L: the length of the initial overlap at k=0; usually L0=Sy+Sx or L0=N−Sy

Zero-crossing: an index j in a sequence of discrete values y(i) such that y(j−1) and y(j) differ in sign yz0: the set of locations of zero-crossings of y in the overlap interval of current interest k: the value that measures the amount of shift of the target frame relative to the source frame; used in the calculation of the cross-correlation coefficients as in equation (1) of Background Art r(k): the normalized cross-correlation coefficients of the source and target signals; the same notation is used whether the full signal of just the envelope of the signal is employed sl(k): a function derived from r(k) that measures the rate of growth of r(k).

kmax: the largest shift-value in each frame for which r(k) and sl(k) are computed kopt: the shift-value k for which r(k) is a maximum over the relevant interval.

In this embodiment of the present invention and in prior methods, the digital signal is processed in frames, primarily to achieve short-term statistical stationarity. A frame should be short enough in time for that purpose, yet long enough to capture reasonably low frequencies. A rule-of-thumb in the art is that frames of the source signal should be about 15-20 milliseconds in duration. Thus, a frame of audio signal digitized at 8 kHz will contain up to N=160 digital values, while one of CD quality (44.1 kHz) will contain between 660 and 880 sampled values.

Figure 2:
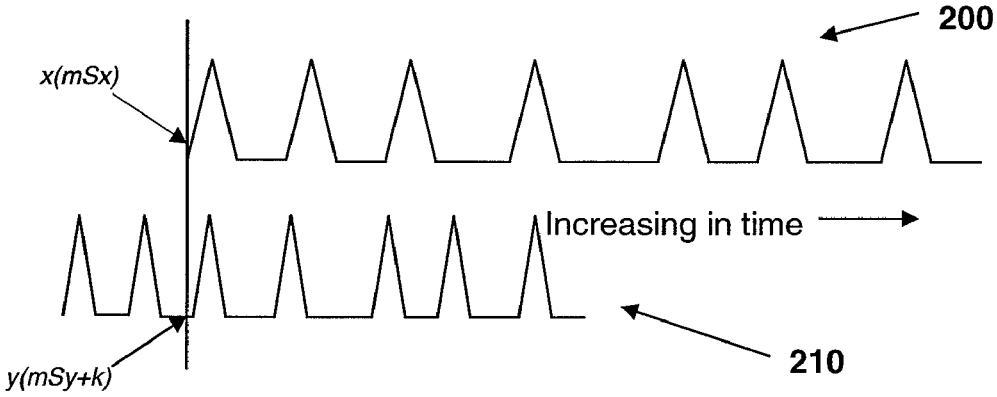
FIG. 2 is a drawing that illustrates how the target segment is conceptually shifted k shift-values to the left relative to the source segment during the process of determining optimal alignment, according to some embodiments of the present invention.

FIG. 2 shows how a processed segment of a digitized signal is overlapped and aligned with an existing source segment. If the new segment 210 is shorter than the source 200, the signal is time-compressed; if it is longer than the source, it is time-expanded. The goal of most time-domain methods, including those of the present invention, is to align the two segments so that they are optimally statistically correlated.

Figure 3:
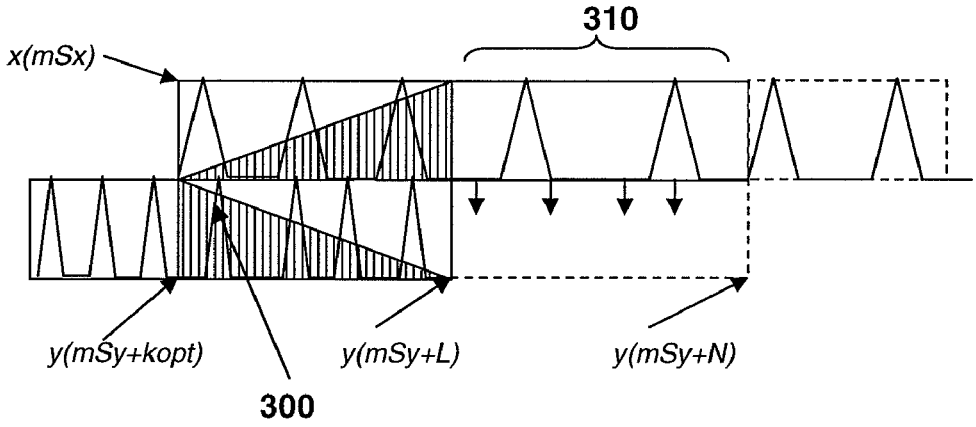
FIG. 3 is a drawing that illustrates how the source and target segments are cross-faded together after alignment, according to some embodiments of the present invention.

Once the optimal overlap point is determined, the two signals are combined by "blending" or "cross-fading" them together with one of a variety of weighted averages or other filters and the succeeding frames are processed, until the source signal has been exhausted. FIG. 3 indicates the cross-fading process. The drawing there shows that the target values are weighted more heavily in the beginning of the blend 300 and the source values more heavily as one moves further out in the frame. After the overlap interval is blended, the remaining values 310 from the source segment are copied directly to the target frame. In both FIG. 2 and FIG. 3, the parameters are labeled in accordance with the glossary above.

If the digital signal is stereo audio (or has more than two channels), two (or more) data streams (one for each channel) are presented to the TSM module. In that case, the method first performs a simple point by point average of the multiple signals to produce a single data signal and proceeds as below, using the averaged signal as the source.

Figure 4:
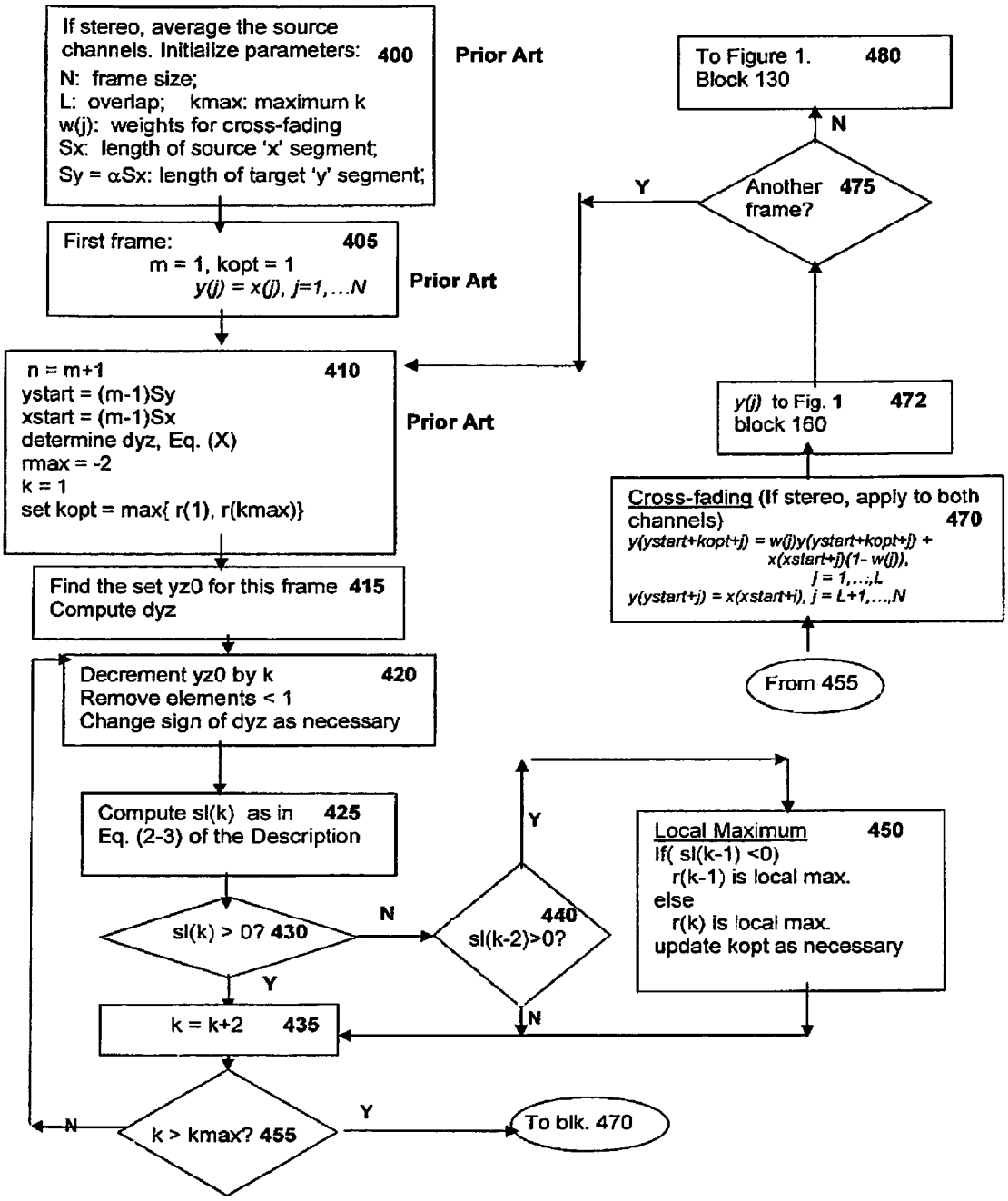
FIG. 4 is a flow chart that shows steps of a Directed Search method, according to some embodiments of the present invention.

Referring now to FIG. 4, in block 400 some parameters are initialized. A person of ordinary skill in the relevant art will understand that the total of all such parameters will depend on the particular implementation. In this exemplary case, if the sampling rate was 44.1 kHz, the frame size N might be 880, Sx might be 440 and Sy would depend on the factor α. The weights used to cross-fade the two signals after the optimum alignment is determined will depend on the complexity and properties of the filter chosen. The "overlap" is usually taken to be a large fraction of N, say the sum of Sx and Sy. For each frame after the first, the correlation coefficients r(k) (Equation (2-1)) are computed for k=1, 2, . . . , kmax, where kmax is usually N/2, but may vary with the particular implementation.

Thus, with the present parameter examples in the prior methods, there would be 440 values of r(k) calculated for each frame, and, if α 0.5 each such coefficient will involve mathematical or logical operations on an average of 320 (=660/2) values, with 50 frames per second. Much of the prior art is devoted to increasing the speed with which these calculations are performed. The present invention replaces the calculation entirely in most cases, with a much shorter one.

In block 405, the first target frame is simply copied from the first source frame, so the optimal overlap is at the start of the frame. In block 410 the pointers into the next frame segments are computed, k is set to 1 and the initial kopt is set equal to the larger of r(l) and r(kmax). A practitioner of ordinary skill in the relevant art will recognize that these two values are not necessarily required in every frame with this method, but they are shown here to simplify FIG. 4 and this Description.

In block 415, the locations of the zero-crossings of just the target signal (denoted y) from y(l) to y(L) are determined and collected in a set denoted yz0. This is done once for each frame. The value of dyz, the difference between the sign of the first zero-crossing located in yz0 and its predecessor in y, is computed. The magnitude of dyz is always 2, but the sign is determined for each frame, as explained in the previous section.

As k increases from 1 to kmax, the effect is to shift the target segment to the left (see FIG. 2), which implicitly requires shifting the set yz0 in the same way. In block 420 that operation is performed. After shifting the locations, which amounts to decrementing the indices, some of the zero-crossing indices may become 0 or negative. This is an indication that they are no longer included in the summation because y has been shifted too far to include them. That also requires a sign change in dyz, which always has the sign of the first zero-crossing that enters the calculation of sl(k).

Given the value of dyz and the adjusted indices in yz0 at the k-th shift-value in the frame, sl(k) can be computed from equation (6) in block 425. This operation requires only one more addition/subtraction than there are remaining locations in yz0, and a left shift to effect the multiplication by dyz. Because the only concern at this point is whether r(k) is increasing or decreasing, there is no need to compute it; the sign of sl(k) provides that information.

Thus, at block 430, sl(k) is tested for positive, which is equivalent to asking if r(k) is increasing. If it is, k is simply increased at block 435 and the method returns to block 420 to process the next sl(k), after determining at block 455 that there are more k's to be processed.

A person of ordinary skill in the relevant art will recognize that there are several options available at this point. The simplest is to increment k by 1 at block 435 and traverse every value of k between 1 and kmax. For purposes of illustration, the exemplary method shown in FIG. 4 uses an increment of 2. This effectively reduces the effort involved in the determination of the optimum point by about one-half, at the slight cost of one additional computation of r at each local maximum. In very rare cases (two local maxima separated by one intermediate point) skipping may miss one of those two maxima, but the aural quality is unaffected, as determined by a series of quantitative and qualitative tests. With no skipping (k incremented by 1), all the local maxima are always found. It is also entirely feasible to skip more shift-values, at a corresponding increase in complexity and computing in the vicinity of a local maximum and with a possible decrease in aural quality if the signal is audio.

If sl(k)<0, r(k) is decreasing, so at block 440, the method also checks the previous value, sl(k−2), again. If the latter is negative, it means r(k) is in a decreasing trend, so k is merely incremented again at block 435 and the next eligible value of sl(k) is processed, unless block 455 indicates that all k's have been examined.

However, if sl(k−2) is positive, that means the search for a local maximum has found one at either k or at k−1 in this embodiment. At block 450, sl(k−1) is computed. If it is negative, k−1 is the location of the local maximum. Otherwise, it is located at k. The appropriate value of r is then computed and compared with the previous maximum for this frame and replacement of the optimum value of k is done as necessary. After that, the method follows the same path toward processing additional k's by returning to block 435, previously described.

If, at block 455, it is determined that the method has run through all the k's for this frame (i.e., the current value of k is greater than kmax), the method moves to block 470, where the process of blending the target signal with the source signal is performed. The key point there is that the blending starts with the target signal positioned at the optimum value of k. The process shown in block 470 uses a simple weighted average to combine the two signals, with w(j) chosen to lie between 0 and 1 in this embodiment. The remainder of the frame is simply copied from the source to the target, as shown in FIG. 3. The step depicted in this block is discussed in detail in several of the references and is well-known to those of ordinary skill in the relevant art.

In the case of multi-channel audio, the single value kopt is applied to each channel of the original signal separately in the blending step in block 470, creating multiple channels of synthesized, time-scaled audio.

Again for simplicity, block 470 depicts the simplest case. A person with ordinary skill in the relevant art would recognize that, because kopt (the optimal alignment point) varies from frame, individual target frames will not be exactly (x times as long as the source frame, even though the average over many frames will be very close to that value. To avoid the possibility of discerning the very slight local phase shifts that can occur as a consequence, one can optionally adjust the interval over which cross-fading is performed to be less than or greater than L in proportion to whether kopt is greater than or less than kmax/2. This provides a uniform length for the target frames that is independent of the alignment point.

In this embodiment, following the blending process, that segment of the target signal is sent to a digital-to-analog converter (block 472) and the method checks at block 475 to see if there are additional frames to be processed. If there are, it returns to block 410 for another cycle. If more data is required, a request is made, as in FIG. 1. Otherwise, the method has finished processing the original signal.

As will be readily apparent to one of ordinary skill in the relevant art in light of this specification, the above described signal processing can be executed from left to right or from right to left.

The method of fast Directed Search has been disclosed, according to some embodiments of the present invention. All but one of the statements in the Summary of The Invention have been demonstrated. These are: the use of sl(k) to test whether r(k) is increasing or decreasing without having to compute the latter; the avoidance of multiplications (or XOR's) and divisions in all instances except at local maxima; the use of zero-crossings to sharply decrease the number of arithmetic operations; the concept of a directed search that determines the direction of growth of r(k) in order to avoid computation where it is not needed.

One statement in the Summary remains to be demonstrated. The assertion that the method is near optimal in number of operations required for the calculation at each k rests on the observation that if one knows the locations of the zero-crossings of the envelope of a signal and the sign of the first one, then the entire sequence of values of the envelope is known. Thus, all the information about the envelope sequence is contained in the zero-crossings. The method disclosed requires one more addition/subtraction than the number of zero-crossings in the calculation of sl(k), which suggests that it would be difficult to lower this number further without losing information. However, the set yz0 of zero-crossings is also shifted at each iteration, so the true number of arithmetic operations is 2n+1 in this invention, where n is the number of zero-crossings for a given k. It is in this sense of information retained or lost that the assertion of near optimal is made.

A person with ordinary skill in the Art will also recognize that other schemes that employ "envelope matching" to increase the speed of the computation, such as skipping more of the shift-values (k), restricting the interval over which r(k) is computed, or avoiding normalization, can be used with this method as well. The difference, however, is that the computation with this method will necessarily be even faster because sl(k) is always faster to compute than r(k). In addition, the probability of finding local maxima increases with this approach when skipping shift-values, because the sign of sl(k) may indicate if such a point has been skipped.

Figure 5:
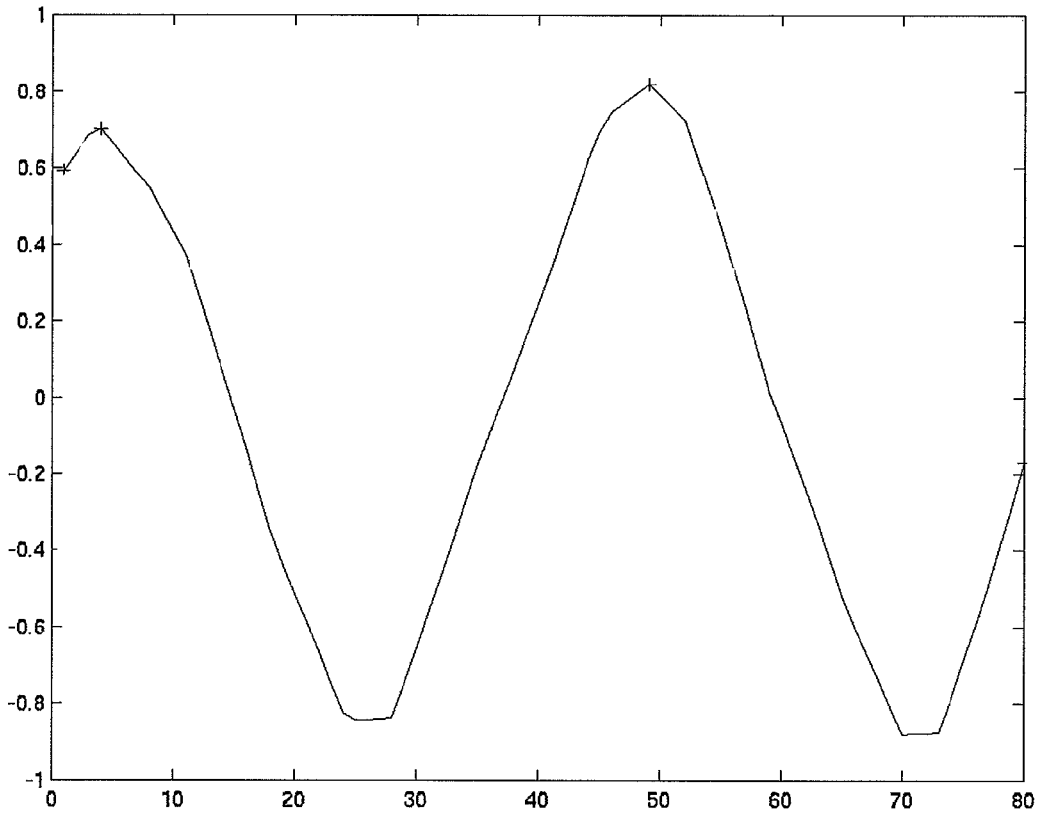
FIGS. 5 and 6 illustrate the results of the method of FIG. 4 on two frames extracted from two different audio signals.
Figure 6:
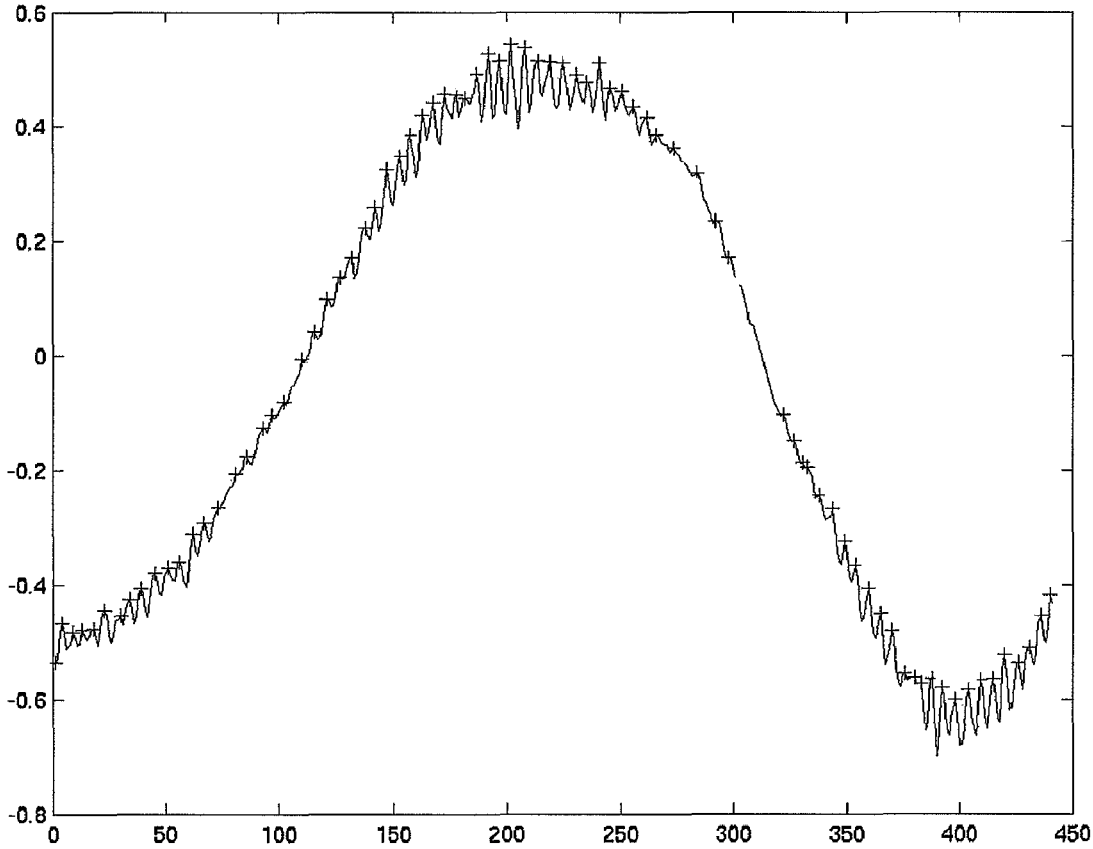

Most frames have relatively few zero-crossings as illustrated in the two examples of FIGS. 5 and 6. FIG. 5 is a graph of r(k) for one frame taken from a segment of a speech file that was digitized at 8192 kHz. The speed-up factor, $\alpha$, was 0.5, there were 80 shift-values per frame and the overlap interval was 120. The method found the true maximum at k=49. There were only four points at which r(k) was actually computed: the two local maxima and the two endpoints, as indicated by the '+' sign. Half the potential shift-values were tested by sl(k).

FIG. 6 is a graph of r(k) for one frame taken from a segment of a music file that was digitized at 44.1 kHz. The speed-up factor was again 0.5, there were 440 k's per frame and the overlap interval was 660. This frame was chosen deliberately because it had a large number of zero-crossings. This is reflected as a "noisy" signal on top of the more slowly oscillating waveform. The method disclosed here accurately located the true maximum at kopt=202 out of a total of 80 local maxima at which r(k) was actually calculated. Half the 440 shift-values were tested by sl(k).

The table that follows summarizes the results of this method, applied to the audio files used for FIGS. 5 and 6. For purposes of comparison, the number of operations is compared with those required for full calculation of r(k) and also envelope matching, as discussed in the section on Background Art. The assumptions for all three methods are the same as in the exemplary case given in this disclosure, including skipping every other k. These numbers are based on the formulas (2) and (3) in the Background Art section and on actual counting within the computation for both audio segments in the case of Directed Search.

Approximate Number of Arithmetic Operations per Second of Audio

| | Speech at 8192 Hz | | Music at 44100 Hz | |
|---|---|---|---|---|
| | # multiplies/ XOR's | # additions | # multiplies/ XOR's | # additions |
| SOLA | 360,000 | 360,000 | 10,890,000 | 10,890,000 |
| EM | 120,000 | 120,000 | 3,630,000 | 3,630,000 |
| Directed Search | 10,800 | 25,360* | 193,050 | 629,694* |

*Conservative upper bound

As will be understood by those familiar with the art, the invention may be embodied in other specific forms without departing from the spirit or essential characteristics thereof. Likewise, the particular naming and division of the portions, modules, agents, managers, components, functions, procedures, actions, layers, features, attributes, methodologies and other aspects are not mandatory or significant, and the mechanisms that implement the invention or its features may have different names, divisions and/or formats. Furthermore, as will be apparent to one of ordinary skill in the relevant art, the portions, modules, agents, managers, components, functions, procedures, actions, layers, features, attributes, methodologies and other aspects of the invention can be implemented as software, hardware, firmware or any combination of the three. Of course, wherever a component of the present invention is implemented as software, the component can be implemented as a script, as a standalone program, as part of a larger program, as a plurality of separate scripts and/or programs, as a statically or dynamically linked library, as a kernel loadable module, as a device driver, and/or in every and any other way known now or in the future to those of skill in the art of computer programming. Additionally, the present invention is in no way limited to implementation in any specific programming language, or for any specific operating system or environment. Furthermore, it will be readily apparent to those of ordinary skill in the relevant art that where the present invention is implemented in whole or in part in software, the software components thereof can be stored on computer readable media as computer program products. Any form of computer readable medium can be used in this context, such as magnetic or optical storage media. Additionally, software portions of the present invention can be instantiated (for example as object code or executable images) within the memory of any programmable computing device. Accordingly, the disclosure of the present invention is intended to be illustrative, but not limiting, of the scope of the invention, which is set forth in the following claims.

What is claimed is:

1. A computer implemented method for time scale digital signal modification, the method comprising the steps of:

for at least one frame of a source signal:

taking, by at least one computer, a sign of a subset of values of the frame;

for each of a subset of shift-values corresponding to the subset of values of the frame:

determining, by the at least one computer, a sign of a slope of a cross correlation function of that shift-value; and responsive to the sign of the slope of the cross correlation function of that shift-value, determining, by the at least one computer, whether that shift-value is a location of a local maximum of said cross correlation function;

determining, by the at least one computer, the value of the cross correlation function for each identified local maximum; and configuring, by the at least one computer, a corresponding frame of a target signal according to a location of the largest identified cross correlation function among the identified local maxima.

2. The method of claim 1 wherein the at least one frame of a source signal comprises:

each frame of the source signal.

3. The method of claim 1 wherein the subset of values of the frame comprises one from a group consisting of:

each value of the frame;

every other value of the frame;

every third value of the frame;

every nth value of the frame, where n is any number less than the total number of values of the frame; and every value of the frame other than n values, where n is any number less than the total number of values of the frame.

4. The method of claim 1 wherein the source and target signals comprise a signal type from a group consisting of:

digital audio signals;

digital video signals; and digital data signals.

5. The method of claim 1 wherein determining, by the at least one computer, a sign of a slope of a cross correlation function for a shift-value further comprises:

utilizing, by the at least one computer, only as many values of the source frame as there are zero crossings of a corresponding shifted frame of the target signal and an associated final value of the source frame.

6. The method of claim 1 wherein:

determining, by the at least one computer, the sign of a slope of a cross correlation function for a shift-value further comprises performing a number of addition and subtraction operations that is one more than a number of zero-crossings in the target frame measured from the shift-value to the end of the frame, together with a single left-shift.

7. The method of claim 6 further comprising:

determining, by the at least one computer, the sign of a slope of a cross correlation function for a shift-value without performing any multiplication, division or logical operations.

8. The method of claim 1 further comprising:

adjusting, by the at least one computer, an interval over which cross fading is performed so as to provide a uniform length for the target frames.

9. The method of claim 1 wherein the source signal comprises a multi-channel audio signal, the method further comprising:

producing, by the at least one computer, a single signal by taking an average of the multiple channels of the multi-channel audio signal; and utilizing, by the at least one computer, the produced single signal as the source signal.

10. At least one non-transitory computer readable medium containing a computer program product for time scale digital signal modification, the computer program product comprising program code for:

for at least one frame of a source signal:

taking a sign of a subset of values of the frame;

for each of a subset of shift-values corresponding to the subset of values of the frame:

determining a sign of a slope of a cross correlation function of that shift-value; and responsive to the sign of the slope of the cross correlation function of that shift-value, determining whether that shift-value is a location of a local maximum of said cross correlation function;

determining the value of the cross correlation function for each identified local maximum; and configuring a corresponding frame of a target signal according to a location of the largest identified cross correlation function among the identified local maxima.

11. The computer program product of claim 10 wherein the at least one frame of a source signal comprises:

each frame of the source signal.

12. The computer program product of claim 10 wherein the subset of values of the frame comprises one from a group consisting of:

each value of the frame;

every other value of the frame;

every third value of the frame;

every nth value of the frame, where n is any number less than the total number of values of the frame; and every value of the frame other than n values, where n is any number less than the total number of values of the frame.

13. The computer program product of claim 10 wherein the source and target signals comprise a signal type from a group consisting of:

digital audio signals;

digital video signals; and digital data signals.

14. The computer program product of claim 10 wherein the program code for determining a sign of a slope of a cross correlation function for a shift-value further comprises:

program code for utilizing only as many values of the source frame as there are zero crossings of a corresponding shifted frame of the target signal and an associated final value of the source frame.

15. The computer program product of claim 10 wherein:

the program code for determining the sign of a slope of a cross correlation function for a shift-value further comprises program code performing a number of addition and subtraction operations that is one more than a number of zero-crossings in the target frame measured from the shift-value to the end of the frame, together with a single left-shift.

16. The computer program product of claim 15 further comprising:

program code for determining the sign of a slope of a cross correlation function for a shift-value without performing any multiplication, division or logical operations.

17. The computer program product of claim 10 further comprising:

program code for adjusting an interval over which cross fading is performed so as to provide a uniform length for the target frames.

18. The computer program product of claim 10 wherein the source signal comprises a multi-channel audio signal, the computer program product further comprising:

program code for producing a single signal by taking an average of the multiple channels of the multi-channel audio signal; and program code for utilizing the produced single signal as the source signal.

19. A computer system for time scale digital signal modification, the computer system comprising:

a processor;

system memory;

means for, for at least one frame of a source signal:

taking a sign of a subset of values of the frame;

for each of a subset of shift-values corresponding to the subset of values of the frame:

determining a sign of a slope of a cross correlation function of that shift-value; and responsive to the sign of the slope of the cross correlation function of that shift-value, determining whether that shift-value is a location of a local maximum of said cross correlation function;

determining the value of the cross correlation function for each identified local maximum; and configuring a corresponding frame of a target signal according to a location of the largest identified cross correlation function among the identified local maxima.

20. The computer system of claim 19 wherein the at least one frame of a source signal comprises:

each frame of the source signal.

21. The computer system of claim 19 wherein the subset of values of the frame comprises one from a group consisting of:

each value of the frame;

every other value of the frame;

every third value of the frame;

every nth value of the frame, where n is any number less than the total number of values of the frame; and every value of the frame other than n values, where n is any number less than the total number of values of the frame.

22. The computer system of claim 19 wherein the source and target signals comprise a signal type from a group consisting of:

digital audio signals;

digital video signals; and digital data signals.

23. The computer system of claim 19 wherein the hardware means for determining a sign of a slope of a cross correlation function for a shift-value further comprise:

hardware means for utilizing only as many values of the source frame as there are zero crossings of a corresponding shifted frame of the target signal and an associated final value of the source frame.

24. The computer system of claim 19 wherein:

the hardware means for determining the sign of a slope of a cross correlation function for a shift-value further comprise hardware means performing a number of addition and subtraction operations that is one more than a number of zero-crossings in the target frame measured from the shift-value to the end of the frame, together with a single left-shift.

25. The computer system of claim 24 further comprising:

hardware means for determining the sign of a slope of a cross correlation function for a shift-value without performing any multiplication, division or logical operations.

26. The computer system of claim 19 further comprising:

hardware means for adjusting an interval over which cross fading is performed so as to provide a uniform length for the target frames.

27. The computer system of claim 19 wherein the source signal comprises a multi-channel audio signal, the computer system further comprising:

hardware means for producing a single signal by taking an average of the multiple channels of the multi-channel audio signal; and hardware means for utilizing the produced single signal as the source signal.

* * * * *

UNITED STATES PATENT AND TRADEMARK OFFICE

CERTIFICATE OF CORRECTION

PATENT NO. : 7,899,678 B2
APPLICATION NO. : 11/622440
DATED : March 1, 2011
INVENTOR(S) : Edward Theil It is certified that error appears in the above-identified patent and that said Letters Patent is hereby corrected as shown below:

Col. 1, line 17, replace "at time at" with "at time αt"

Col 7, line 66, replace "Eq. (3)" with "(Eq. (3)"

Col. 8, Formula (2-1) replace $$r(k+1) - r(k) = \left( \frac{\sum_{i=1}^{L_{k+1}} sign(y(k+1+i))sign(x(i))}{L_{k+1}} - \frac{\sum_{i=1}^{L_k} sign(y(k+1))sign(x(i))}{L_k} \right) \quad \textbf{(2-1)}$$

with $$r(k+1) - r(k) = \left( \frac{\sum_{i=1}^{L_{k+1}} sign(y(k+1+i))sign(x(i))}{L_{k+1}} - \frac{\sum_{i=1}^{L_k} sign(y(k+i))sign(x(i))}{L_k} \right) \quad \textbf{(2-1)}$$

Signed and Sealed this
Twenty-sixth Day of April, 2011

David J. Kappos

David J. Kappos
*Director of the United States Patent and Trademark Office*